US005180651A

United States Patent [19]

Mason

[11] Patent Number: 5,180,651

[45] Date of Patent: Jan. 19, 1993

[54] METHOD FOR THE ADDITION OF POWDERS TO PHOTOGRAPHIC SYSTEMS

[75] Inventor: Eileen Mason, Penrose, N.C.

[73] Assignee: E. I. Du Pont de Nemours and Company, Wilmington, Del.

[21] Appl. No.: 693,897

[22] Filed: May 1, 1991

Related U.S. Application Data

[63] Continuation-in-part of Ser. No. 555,760, Jul. 23, 1990, abandoned.

[51] Int. Cl.[5] ..... G03C 1/72

[52] U.S. Cl. ..... 430/138; 430/496; 430/497; 430/517; 430/546; 430/559; 430/569; 430/570; 430/631; 430/642; 430/935; 252/174.13

[58] Field of Search ..... 430/138, 559, 496, 497, 430/450, 465, 546, 517, 642, 631, 935, 570, 569; 252/174.13; 428/402.24; 503/214

[56] References Cited

U.S. PATENT DOCUMENTS

| | | | |
|---|---|---|---|
| 2,360,289 | 10/1944 | Thomas | 430/546 |
| 4,137,194 | 1/1979 | McCune, Jr. | 427/50 |
| 4,140,530 | 2/1979 | Trunley et al. | 430/569 |
| 4,146,399 | 3/1979 | Trunley et al. | 430/569 |
| 4,683,193 | 7/1987 | Ihama et al. | 430/570 |
| 4,741,996 | 5/1988 | Aotsuka et al. | 430/559 |
| 4,861,695 | 8/1989 | Higashiyama | 430/138 |
| 4,865,938 | 9/1989 | Sakai et al. | 430/138 |
| 4,900,653 | 2/1990 | Factor et al. | 430/522 |
| 4,904,561 | 2/1990 | Yamamoto | 430/138 |
| 4,940,654 | 7/1990 | Diehl et al. | 430/522 |
| 4,948,717 | 8/1990 | Diehl et al. | 430/510 |
| 4,948,718 | 8/1990 | Factor et al. | 430/517 |
| 4,950,586 | 8/1990 | Diehl et al. | 430/517 |

*Primary Examiner*—Marion E. McCamish
*Assistant Examiner*—Janis L. Dote

[57] ABSTRACT

A process for improving the method by which a powder such as a dye is added to a gelatino silver halide element is described. This process involves encapsulating the powder within a gelatin capsule. This process avoids cross-contamination and dusting when powder is added to solvent and also reduces the use of extra solvent in the manufacture of the element.

13 Claims, No Drawings

METHOD FOR THE ADDITION OF POWDERS TO PHOTOGRAPHIC SYSTEMS

RELATED PATENT APPLICATION

The present patent application is a continuation-in-part of Ser. No. 07/555,760 filed Jul. 23, 1990, now abandoned.

BACKGROUND OF THE INVENTION

1. Field of the Invention

This invention relates to a process of preparing and making of photographic emulsions. Specifically, this invention relates to a particular method for the addition of a powdered material such as dyes to a photographic system. Examples of dyes include spectral sensitizing dyes, filter dyes and antihalation dyes. Also the present invention relates to emulsions containing such powders.

2. Discussion of the Prior Art

During the preparation of gelatino, silver halide emulsions, the addition of a powder such as a dye is useful such as for spectral sensitization, image quality improvement or antihalation. Illustratively in the case of sensitization, such property may take the form of so-called "chemical sensitization" wherein various ingredients are added to change the sensitometry thereof. Alternatively, it may also be necessary to alter the spectral response of the emulsions for one reason or another. If this is required, so-called "spectral sensitizing" dyes are added to this aqueous dispersion of gelatin and silver halide. As well known in the art spectral sensitizing dyes are not very soluble in either an aqueous or in a mixture of organic/aqueous solvents. Adding the dye as a solution therefore requires large volumes of material only a small fraction of which actually provide useful photographic properties and the rest adds volume which must be subsequently removed. Furthermore, it is well known in the art that many dyes began to decompose in solution resulting in decomposition products which may be detrimental to the photographic properties of the emulsion. This typically requires the establishment of a shelf life after which the dye solution is discarded thereby adding substantial cost to the overall operation.

Alternatives to adding the dye dissolved in a solution are described in the literature. Dispersion of the dye in hydrophilic colloid as exemplified in Owens, et al., U.S. Pat. Nos. 3,660,101 and 3,469,987; Ihama et al., U.S. Pat. No. 4,683,193. These methods require various combinations of heating cycles, precipitation, and high shear stirring all of which are time consuming and detrimental to the dye as mentioned above. The use of surfactants has also been taught, however, this method requires the addition of surfactants to the emulsion which may alter the photographic properties of the emulsions. Microencapsulation has been employed extensively in the art as exemplified in Keys, et al., U.S. Pat. No. 4,755,446 and Nelson, U.S. Pat. No. 4,798,741. Microencapsules are formed by various methods such as coacervation, interfacial polymerization, polymerization of one or more monomers in an oil, etc., with a typical result being a microcapsule with a size of 0.1 to 25 μm. Extreme care must be taken with these techniques since the dye must be completely inert to the chemical reactions involved in microcapsule formation. Furthermore, during the formation of microcapsules, impurities such as solvent are typically occluded within the microcapsules and therefore are added to the emulsion with the microcapsules.

Other methods of dye addition are taught as exemplified in, for example, Diehl, et al., U.S. Pat. No. 4,948,717, wherein filter dyes are added as a solid dye dispersion. However, this method is not useful for sensitizing dyes or the addition of other solid materials to an emulsion. Handling of a solid dye with this technology typically generates airborne dust particles which may cause respiratory problems.

In light of these techniques, there is a pressing need in the art for a method of adding a wide array of solid materials to a photographic emulsion without the problems associated with solution techniques, microencapsulation techniques and solid particle additions.

SUMMARY OF THE INVENTION

It is an object of this invention to provide a system for the addition of a powder such as a dye to a gelatino, silver halide emulsion without the necessity of forming a solution of the powder. It is yet another object to provide a system which avoids dusting and the like. These and yet other objects are achieved in a process for the addition of powder to a photographic emulsion wherein said powder is contained within a plurality of preformed, two-part gelatin capsules.

Therefore the present invention is directed to a process for the formation of a photographic emulsion containing a powder comprising the steps of (a) forming a plurality of gelatin capsules wherein each of the capsules is formed from two separate sections (b) inserting dry powder into each of the plurality of gelatin capsules (c) adding the gelatin capsules containing the powder to a photographic emulsion.

DETAILED DESCRIPTION OF THE INVENTION

The use of preformed, two-part gelatin capsules is a well known process in the prior art. For example, it is known in the pharmaceutical industry to package medicines in such capsules for controlling the dose a patient receives. The advantages are numerous and include formation of the capsule pieces separate from the preparation of the internal material. Furthermore, capsules of different sizes can be used without altering the process for formation of the internal material. A wide variety of capsule sizes are available commercially with typical volumes of 0.13 $cm^3$ to 1.37 $cm^3$ used in the pharmaceutical industry. Capsule formation is well known in the art as exemplified in U.S. Pat. Nos. 4,247,006 and 3,614,812 is known in other applications, however, such a technique has not been employed in conjunction with adding photographically useful dyes to a photographic emulsion.

A two-part capsule is employed in its normal definition with the capsule having an outside wall portion formed from two discrete sections which join one another in formation of a hollow interior. The dry powder such as a dye is inserted into a capsule only after the two separate sections are formed.

It is necessary to obtain a uniform dispersion or solution of the powder introduced into the photographic emulsion. Therefore the gelatin capsule will dissolve readily in the photographic emulsion. In order to speed the rate of dissolution of the gelatin capsule, an elevated temperature may be employed. Such elevated temperature, if employed, is not considered critical with a practical upper limit being a temperature immediately below a degradation temperature of the emulsion. Generally, dissolution of the gelatin capsule with release of the powder into the emulsion will take place within one hour following introduction of the capsule into the emulsion. Preferably dissolution of the capsule with take place within thirty minutes and more preferably within ten minutes. It is understood that the emulsion need not contain all of its components at the time of introduction of the capsules.

It is understood that a two-part capsule exclude a microcapsule which is not formed into two discrete sections. Also it is understood in the present invention that a plurality of capsules contains all or substantially all of a specific powder such as a dye wherein each capsule is a separate and distinct entity as opposed to known techniques in formation of a gel, paste or slurry.

In the photographic industry it is sometimes necessary to add powdered materials such as dyes to the system. These dyes for example can be of the sensitizing, filter or antihalation type and they can be added to an under or backing layer. Dyes of this type often are generally large, organic compounds and some have very complex structures. Many of the compounds are usually not very soluble in water and thus generally are either dispersed as a dilute water solution or some water miscible combination such as the lower alcohols or ketones. The problem of adding the dye to the solvent is obvious. These dyes are conventionally fine, powdered materials and will color, stain and even cause physical problems if ingested while airborne. It has long been a practice in the prior art to add these dyes dissolved since it was thought that only in this manner would the dye be properly adsorbed to the silver halide grains or dispersed within the gelatin binder, for example. Thus, no efforts have been made to add dyes of this nature in an encapsulated form. Other methods have been tried with varying results in addition of dyes to photographic systems such as by granulating or pelletizing the dye prior to addition of this material to the emulsion. Although these processes avoid the addition of extra solvent and the dusting problems in making up the solution of the dye, the pelletizing or granulating retards the solution of the dye within the gelatin or emulsion materials. Thus, sometimes, good dispersion of the dye is not achieved by these methods.

In the practice of my invention, the dry dye powder is encapsulated within a two-part gelatin capsule. The capsules are preformed and the dry dye powder can be inserted therein using a conventionally known machine such as the Type 8 Standard Hard Capsule Filling Machine designed by CAPSUGEL, a Division of Warner-Lambert Co., Highland Park, Mich. These dye capsules can then be stored for long periods of time prior to use. Since a known amount of dry dye is placed within each capsule, the amount of dye added to the emulsion or gelatin layers is easily controlled. Since the gelatin capsules are compatible with the gelatin conventionally used within these photographic systems, problems of dispersion of the dye prevalent with other, dry methods, are not a problem here. Thus, one only needs to insure that the capsules have some time to dissolve and the dye will enter the emulsion properly. Since the capsules are essentially dry and dust-free, the problems of dry dye dispersion are also eliminated as is the addition of extra solvent and the like.

Although the previous discussion has been in relationship to a powder which is a dye it is within the scope of the present invention that other powders are encapsulated in a two-part capsule. Other materials which are introduced into the photographic emulsion in powder form, such as a sensitizer, can be incorporated.

This invention will now be illustrated by the following examples wherein all parts and percentages are by weight unless otherwise indicated:

EXAMPLE 1

This example demonstrates the use of encapsulated, photographic sensitizing dye within a gelatino, silver halide emulsion.

A conventional, silver bromoiodide, tabular grain emulsion (ca. 98% Br and ca. 2% I) was prepared as well-known to those of normal skill in the art. This emulsion was then dispersed in a bulking amount of gelatin and brought to its optimum sensitivity with gold and sulfur salts as is also well-known. Standard antifoggants, wetting and coating aides were also present as well as hardeners. Since tabular grains have a low sensitivity in the green spectrum of the visible region, it is conventional to add a green spectral sensitizing dye to the emulsion in order to increase the sensitivity thereof. In this case, 800 gms of a carbocyanine dye in an amount of 2 gms per 1.5 moles silver and tartrazine, i.e.,

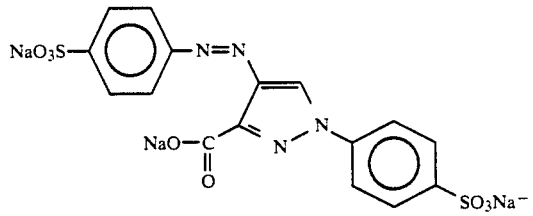

which had been encapsulated using the aforementioned Type 8 Encapsulator, were added to this emulsion and digested for a period of 60 minutes at 39° C. In this case, the dye containing capsules were of 00 size and each capsule contained about 320 mg of the aforesaid dye. In addition, 215 gms of encapsulated tartrazine dye were also added to improve the image quality of this element. For control purposes, a similar emulsion was prepared using the aforementioned dyes in a conventional manner, i.e., where the carbocyanine dye was dissolved in alcohol and tartrazine was dissolved in water. During the dissolution of these dyes in the solvent, "dusting" was observed which was undesirable.

Both emulsions were coated on a standard dimensionally stable polyethylene terephthalate film support which had been previously subbed with resin and gelatin sub layers to improve the adhesion of the emulsion. The emulsion layers were coated to a coating weight of 4.7 mg $Ag/dm^2$ and then an overcoat layer of gelatin was applied supra thereto. After drying, samples of both elements were given a conventional exposure, developed, fixed, washed and dried. The physical and sensitometric properties of these elements were equivalent indicating that the encapsulated dyes had been dispersed and absorbed by the silver halide grains.

EXAMPLE 2

This example demonstrates the use of the encapsulation process for the preparation of an antihalation layer.

An emulsion suitable for preparing an antihalation layer was made by mixing 900 gms of an encapsulated Acid Violet 520 dye of the following structure:

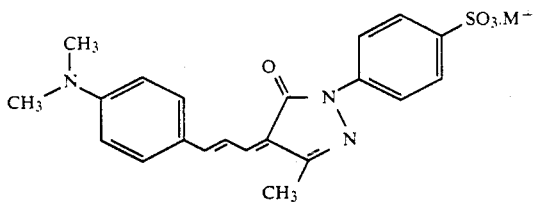

This material was encapsulated using the same equipment as Example 1 and the capsules contained in the neighborhood of 300 to 500 mg of dye per capsule. The backing solution also contained about 60,000 gms of gelatin and about 690,900 gms of water. Additionally, this solution contained the usual wetting and coating aides and hardeners. The capsules were dispersed in this solution at 60° C. for about 3 minutes and appeared to be fully compatible with this mixture. For control purposes, the same dye dissolved in water was used. Both gelatin solutions were coated on standard polyester base and a standard emulsion layer coated on the opposite side thereto. Both antihalation layers were equivalent in every respect as regards optical density and ability to absorb scattered light. The sensitometry of the silver halide emulsion layers were also equivalent.

Thus, the procedure described in this invention can be used with dyes used within any conventional, gelatino, silver halide element. Cross contamination of various dyes which might be used to prepare any variety of element is avoided as well as the dusting and dirt problem normally associated with the dissolution of dyes into solvents. The addition of alternate solvents to the silver halide emulsion is also avoided by the practice of this invention.

What is claimed is:

1. A process for the formation of a photographic emulsion containing a powder comprising the steps of (a) forming a plurality of gelatin capsules wherein each of the capsules is formed from two separate sections, (b) inserting dry powder into each of the plurality of gelatin capsules, (c) adding the gelatin capsules containing the powder to a photographic emulsion, and (d) dissolving the gelatin capsules within the . emulsion to allow release of the powder with the emulsion to obtain a uniform dispersion or solution of the powder.

2. The process of claim 1 wherein the powder is a dye.

3. The process of claim 2 wherein said dye is a photographic sensitizing dye.

4. The process of claim 2 wherein said dye is an antihalation dye.

5. The process of claim 2 wherein said dye is a filter dye.

6. The process of claim 2 wherein the dissolving of the capsules to release the powder takes place within one hour after introduction into the emulsion.

7. The process of claim 6 wherein the dissolving takes place within thirty minutes.

8. The process of claim 7 wherein the dissolving takes place within ten minutes.

9. A photographic emulsion containing a powder encapsulated within a plurality of gelatin capsules wherein each of the capsules is formed from two separate sections.

10. The photographic emulsion of claim 9 wherein the powder is a dye.

11. The emulsion of claim 10 wherein said dye is a photographic sensitizing dye.

12. The emulsion of claim 10 wherein said dye is an antihalation dye.

13. The emulsion of claim 10 wherein said dye is a filter dye.

* * * * *